US006084502A

United States Patent [19]

Ariga et al.

[11] Patent Number: 6,084,502

[45] Date of Patent: Jul. 4, 2000

[54] RESISTOR AND METHOD OF MAKING THE SAME

[75] Inventors: Shuji Ariga; Takeshi Iseki, both of Osaka, Japan

[73] Assignee: Matsushita Electric Industrial Co., Ltd., Osaka, Japan

[21] Appl. No.: 09/168,025

[22] Filed: Oct. 8, 1998

Related U.S. Application Data

[62] Division of application No. 08/815,080, Mar. 11, 1997, abandoned.

[30] Foreign Application Priority Data

Mar. 11, 1996 [JP] Japan ..... 8-052790

[51] Int. Cl.[7] ..... H01C 10/00

[52] U.S. Cl. ..... 338/195; 338/307

[58] Field of Search ..... 338/195, 307, 338/306; 29/610.1, 620

[56] References Cited

U.S. PATENT DOCUMENTS

| | | | |
|---|---|---|---|
| 2,533,409 | 12/1950 | Tice | 219/213 |
| 2,641,675 | 6/1953 | Hannahs | 174/253 |
| 3,512,254 | 5/1970 | Jenkins et al. | 29/620 |
| 4,041,440 | 8/1977 | Davis et al. | 338/195 |
| 4,242,660 | 12/1980 | Cocca | 338/195 |
| 4,352,005 | 9/1982 | Evans et al. . | |
| 4,375,056 | 2/1983 | Baxter et al. | 338/25 |
| 4,429,298 | 1/1984 | Oberholzer | 338/195 |
| 4,505,032 | 3/1985 | Praria | 338/195 |
| 4,626,822 | 12/1986 | Melkeraaen | 338/195 |
| 4,647,899 | 3/1987 | Moy | 338/309 |
| 4,647,906 | 3/1987 | Naylor et al. . | |
| 4,906,966 | 3/1990 | Imamura et al. | 338/195 |
| 5,015,989 | 5/1991 | Wohlfarth et al. | 338/195 |
| 5,198,794 | 3/1993 | Sato et al. | 338/195 |
| 5,206,623 | 4/1993 | Rochette et al. | 338/203 |

FOREIGN PATENT DOCUMENTS

| | | | |
|---|---|---|---|
| 520353 | 12/1992 | European Pat. Off. . | |
| 3021288 | 12/1981 | Germany | 338/195 |
| 55-44745 | 3/1980 | Japan | 338/195 |
| 58-142502 | 8/1983 | Japan . | |
| 60-163402 | 8/1985 | Japan . | |
| 1-164001 | 6/1989 | Japan . | |
| 1469321 | 4/1977 | United Kingdom | 338/195 |
| 2184893 | 12/1985 | United Kingdom | 338/309 |

OTHER PUBLICATIONS

Gow, III et al., "Thin Film High Aspect Ration Trim Bar Resistor", IBMTDB, V.21, No. 9, p. 3601. (Feb. 1979).

Kiang et al., "Folded Pattern For Film Resistor with Trimmable Elements in Binary Sequence", IBMTDB vol. 25, No. 4, pp. 2003–2004 (Sep. 1982).

*Primary Examiner*—Karl Easthom
*Attorney, Agent, or Firm*—McDermott, Will & Emery

[57] ABSTRACT

The present invention is directed towards a resistor which has higher load-, surge-, and pulse-resistant characteristics and is capable of having a resistance adjusted at a higher rate of precision. A pair of electrodes 12 and a main resistance path 13 between the two electrodes 12 are mounted on a substrate 11. The main resistance path 13 is joined to a set of first rungs 14 which extend parallel to the main resistance path 13 and are joined with two first connecting paths 15 to form a first ladder-like resistance path for rough adjustment of the resistance which is connected to a part of the main resistance path 13. Also, a second ladder-like resistance path for fine adjustment of the resistance which comprises a set of second rungs 16 extending vertically from the main resistance path 13 and two second connecting paths 17 joining the second rungs 16 together is formed and connected to a part of the main resistance path 13. A combination of the two ladder-like resistance paths of a resistive body for rough and fine adjustments of the resistance permits a desired resistance to be set at a higher precision thus providing the higher load-, surge-, and pulse-resistant characteristics of a resultant resistor. Alternatively include first and second resistance paths 20 and 21 without rungs for similar rough and fine adjustment.

2 Claims, 10 Drawing Sheets

RESISTOR AND METHOD OF MAKING THE SAME

This is a divisional of application Ser. No. 08/815,080, filed Mar. 22, 1997, now abandoned.

BACKGROUND OF THE INVENTION

1. Field of the Invention

The present invention relates to a resistor for use in an electronic apparatus and a method of making the same.

2. Description of Prior Art

Commonly, electrodes and a resistive body for a square chip resistor are produced in a combination by a thick-layer method including printing and baking steps or vapor deposition and sputtering method. The resistor body is then trimmed by laser to have a desired value of resistance. However, the resistor body when being trimmed by laser may be damaged along the trimmed edge by the heat of laser hence lowering its load or pulse characteristic. For compensation, the resistor body is provided locally with a ladder-like resistance path(s) across which the trimming is made to determine a desired resistance.

The conventional resistor having such ladder-like resistance paths will now be explained.

On example of the conventional ladder-like resistance path equipped resistor is disclosed in Japanese Patent Laid-open Publication No. S60-163402 as shown in a plan view of FIG. 19. As shown, there are provided a substrate 1 made of alumina, electrodes 2 made of nickel-chromium and gold and located on both side ends of the substrate 1 to extend from the upper surface to the lower surface, and resistor bodies 3, 4, and 5 made of a tantalum thin film and located on the upper surface of the substrate 1 between the two electrodes 2. More specifically, denoted by 3 is a main resistance path while 4 and 5 are ladder-like resistance paths arranged in parallel to the main resistance path 3. The ladder-like resistance path 5 is greater in the cross section of the resistive body then the ladder-like resistance path 4. Denoted by 6 are slit grooves made by laser trimming for slitting the ladder-like resistance paths.

A method of making the conventional resistor is explained.

First, layer patterns of tantalum thin-film resistor body and nickel-chromium/gold electrode element are formed on the substrate 1 made mainly of 96% pure alumina with a known magnetron sputtering apparatus.

The resistive body and the electrodes are then shaped by a photo-etching technique and heated at 350° C. for one hour.

This is followed by laser trimming the ladder-like resistance path 4 of the small resistive cross section for adjusting the resistance to a roughly desired value which can be shifted to a final, precise resistance of the resistor by trimming the large resistive cross section of the ladder-like resistance path 5.

Finally, the ladder-like resistance path 5 of which resistive cross section is greater than that of the ladder-like resistance path 4 hence allowing a small increase of the resistance when it is cut apart is trimmed by laser for fine adjustment to the precise resistance value. As the result, the resistor with the precise resistance will be produced.

As the resistive body pattern with the ladder-like resistance paths is being laser trimmed, its resistance van be changed to a precise value at steps. Also, as no current runs through the trimmed edge portions of the resistive body which have been affected by laser heat during the trimming, the resistor will be improved in the load-, surge- and pulse-resistant characteristics.

It is however necessary for fine adjustment to a precise resistance value in the arrangement of the conventional resistor to have the ladder-like resistance path formed greater in the resistive cross section than the main resistance path so that a change in the resistance is minimized when the ladder-like resistance path of the resistive body is trimmed. Hence, the resistive cross section of the ladder-like resistance path of the resistive body has to be increased considerably in relation to that of the main resistance path for determining a desired resistance value with tolerance of less than ±5%. Particularly for producing small-sized tip resistors, the ladder-like resistance path should be arranged with as possible as a minimum distance between the rungs or a minimum number of the rungs since it is hardly adjusted to have a precise value of resistance by only means of the laser trimming. It has hence been desired to develop improved resistors which have ladder-like resistance paths provided substantially identical in the size of resistive cross section to the conventional ones but are adapted for having a desired resistance determined at a higher precision thus giving higher load-, surge-, and pulse-resistant characteristics.

SUMMARY OF THE INVENTION

It is an object of the present invention to provide a resistor arranged to have a desired resistance determined by highly precise adjustment thus providing higher load-, surge-, and pulse-resistant characteristics.

A resistor according to the present invention is provided having a resistive body composed of a first ladder-like resistance path arranged of which rungs for rough adjustment of the resistance extend in parallel to a main resistance path or a first resistance adjusting path which can be trimmed vertical to the main resistance path for adjustment of the resistance, and a second ladder-like resistance path arranged of which rungs for fine adjustment of the resistance extend vertical to the main resistance path or a second resistance adjusting path which can be trimmed in parallel to the main resistance path for adjustment of the resistance.

DETAILED DESCRIPTION OF THE INVENTION

First Embodiment

Figure 1:
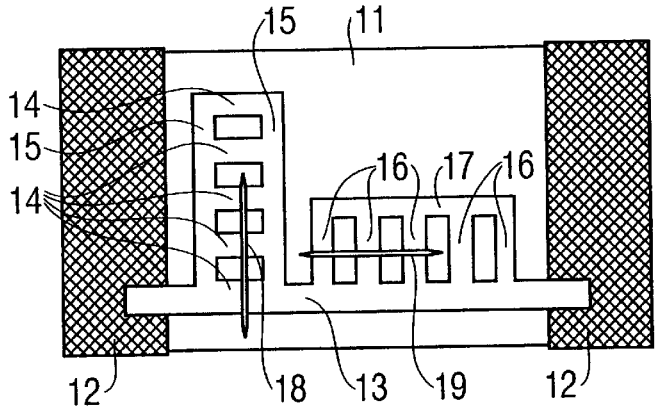
FIG. 1 is a plan view of a resistor according to a first embodiment of the present invention.

FIG. 1 is a plan view of a resistor having a resistive body composed of ladder-like resistance paths showing a first embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both sides ends of the substrate 11 to wrap the ends to the upper and lower sides. A main resistance path 13 is provided between the two electrodes 12 and arranged in parallel to a set of first rungs 14. The first rungs 14 are bridged between a couple of first connecting paths 15 joined to the main resistance path 13. Accordingly, the first rungs 14 and the two first connecting paths 15 constitute a first ladder-like resistance path of which rungs extend in parallel to the main resistance path 13. Also, a set of second rungs 16 extend vertically from the main resistance path 13. The second rungs 16 are joined by a second connecting path 17. Accordingly, the second rungs 16 and the second connecting path 17 constitute a second ladder-like resistance path of which rungs extend vertically from the main resistance path 13. The segments 13, 14, 15, 16, and 17 are members of a resistive body made of e.g. ruthenium oxide. Denoted by 18 is a first slit groove formed by laser trimming of the first ladder-like resistance path for rough adjustment of the resistance. Similarly, a second slit groove 19 is formed by laser trimming of the second ladder-like resistance path for fine adjustment of the resistance.

A method of making the resistor of the first embodiment of the present invention which has the resistive body composed of such two ladder-like resistance paths as explained above will be described in detail.

Figure 2:
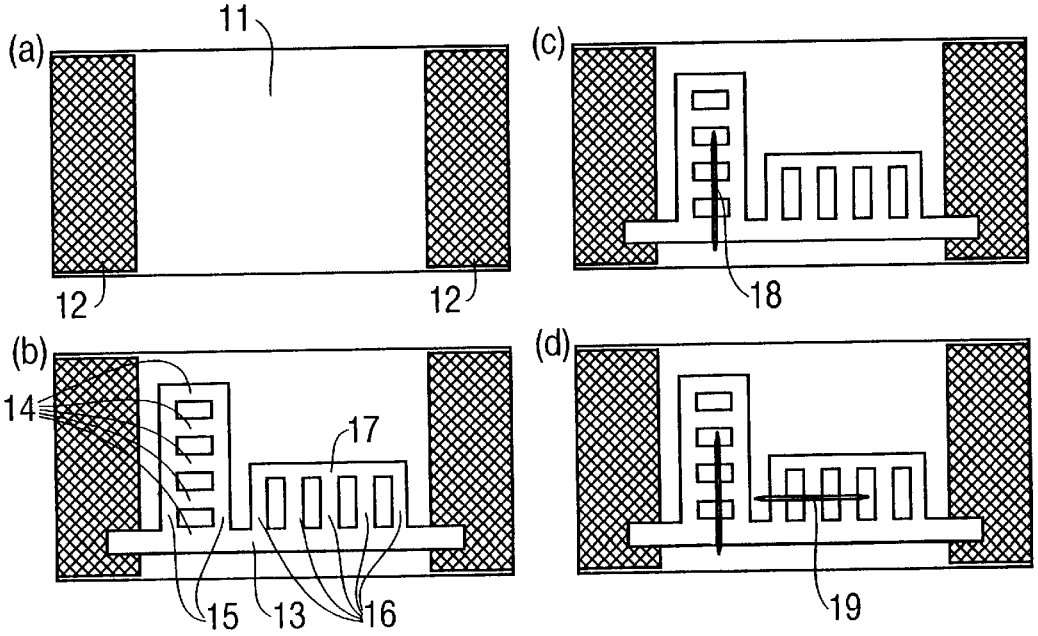
FIG. 2 is a diagram explaining steps of producing the resistor shown in FIG. 1.

FIG. 2 illustrates steps of the method of making the resistor of the first embodiment of the present invention which has the resistive body composed of the two ladder-like resistance paths.

After the substrate 11 made mainly of 96% pure alumina is coated by printing with a pattern of silver glazing paste for the electrodes 12, it is passed in a conveyor belt oven and baked at 850° C. for 5 to 10 minutes, a total of 30 to 60 minutes, to cure the electrodes 12, as shown in FIG. 2(*a*).

Then, a pattern of a resistive body which comprises a man resistance path 13 connecting the two electrodes 12, a set of first rungs 14 arranged parallel to the main resistance path 13, a pair of first connecting paths 15 joining the first rungs 14 inbetween and connected to the main resistance path 13, a set of second rungs 16 extending vertically from the main resistance path 13, and a second connecting path 17 joining the second rungs 16 is printed with a ruthenium oxide glazing paste, as shown in FIG. 2(*b*), and baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can be further adjusted to a final, precise resistance is obtained, as shown in FIG. 2(*c*).

Also, such a number of the second rungs 16 from one side are cut apart by laser trimming that the final precise resistance is obtained, as shown in FIG. 2(*d*). As the result, a resistor having the final, precise resistance will be completed.

The laser trimming of a number of the rungs of the ladder-like resistance paths of the resistive body depends on a resistance level of the resistor.

The operation of the resistor of the first embodiment of the present invention is now explained with its resistive body having the ladder-like resistance paths.

When a given number of the first rungs 14 from the main resistance path 13 side are cut apart, the first ladder-like resistance path makes a detour and its resistance is significantly increased hence permitting rough adjustment of the resistance. When a particular number of the second rungs 16 are cut apart, the length of the second ladder-like resistance path remains nearly unchanged but the resistive cross section is slightly reduced. This allows the resistance of the second ladder-like resistance path to provide a very small increase. Also, the resistance increase is substantially proportional to the number of the trimmed rungs 19. Accordingly, the resultant resistance after the trimming can easily be predicted thus contributing to the fine adjustment. For example, the first ladder-like resistance path permits rough adjustment of the resistance with tolerances of −10% to −5% through trimming the first rungs 14 while the second ladder-like resistance path allows fine adjustment of the resistance with tolerances of ±1% ±2% through trimming the second rungs 16. As understood, the ladder-like resistance paths of the resistive body of the first embodiment are fabricated with much ease as well as permits adjustment of the resistance at a higher precision.

Furthermore, trimmed portions, which may be injured by heat generated by the laser trimming, of the ladder-like resistance paths of the resistive body of the first embodiment allow no flow of currents hence ensuring higher load-, surge-, and pulse-resistant characteristics of the resistor.

It is also possible for more precise adjustment to minimize the change of resistance by having the second connecting path 17 arranged smaller in the resistive cross section than the main resistance path 13.

Second Embodiment

Figure 3:
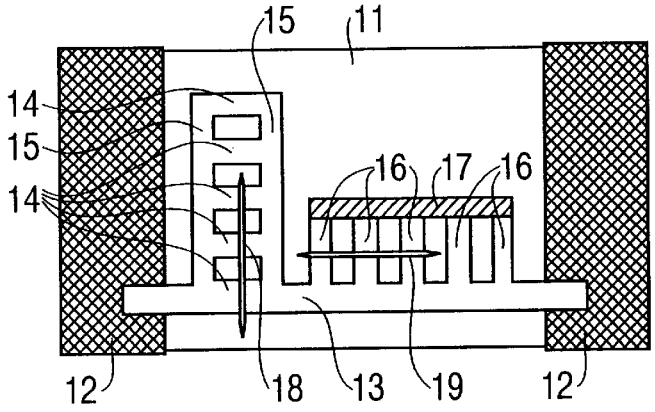
FIG. 3 is a plan view of a resistor according to a second embodiment of the present invention.

FIG. 3 is a plan view of a resistor according to a second embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is provided between the two electrodes 12 and arranged in parallel to a set of first rungs 14. The first rungs 14 are bridged between a couple of first connecting paths 15 joined to the main resistance path 13. Accordingly, the firs rungs 14 and the two first connecting paths 15 constitute a first ladder-like resistance path of which rungs extend in parallel to the main resistance path 13. Also, a set of second rungs 16 extend vertically from the main resistance path 13. The second rungs 16 are joined by a second connecting path 17. Accordingly, the second rungs 16 and the second connecting path 17 constitute a second ladder-like resistance path of which rungs extend vertically from the main resistance path 13. The segments 13, 14, 15, and 16 are members of a resistive body made of e.g. ruthenium oxide. The second connecting path 17 is a resistive body made of e.g. ruthenium oxide which is higher in the specific resistance than the main resistance path 13. Denoted by 18 is a first slit groove formed by laser trimming of the first ladder-like resistance path for rough adjustment of the resistance. Similarly, a second slit groove 19 is formed by laser trimming of the rungs 16 of the second ladder-like resistance path for fine adjustment of the resistance.

A method of making the resistor of the second embodiment of the present invention will be described in detail.

Figure 4:
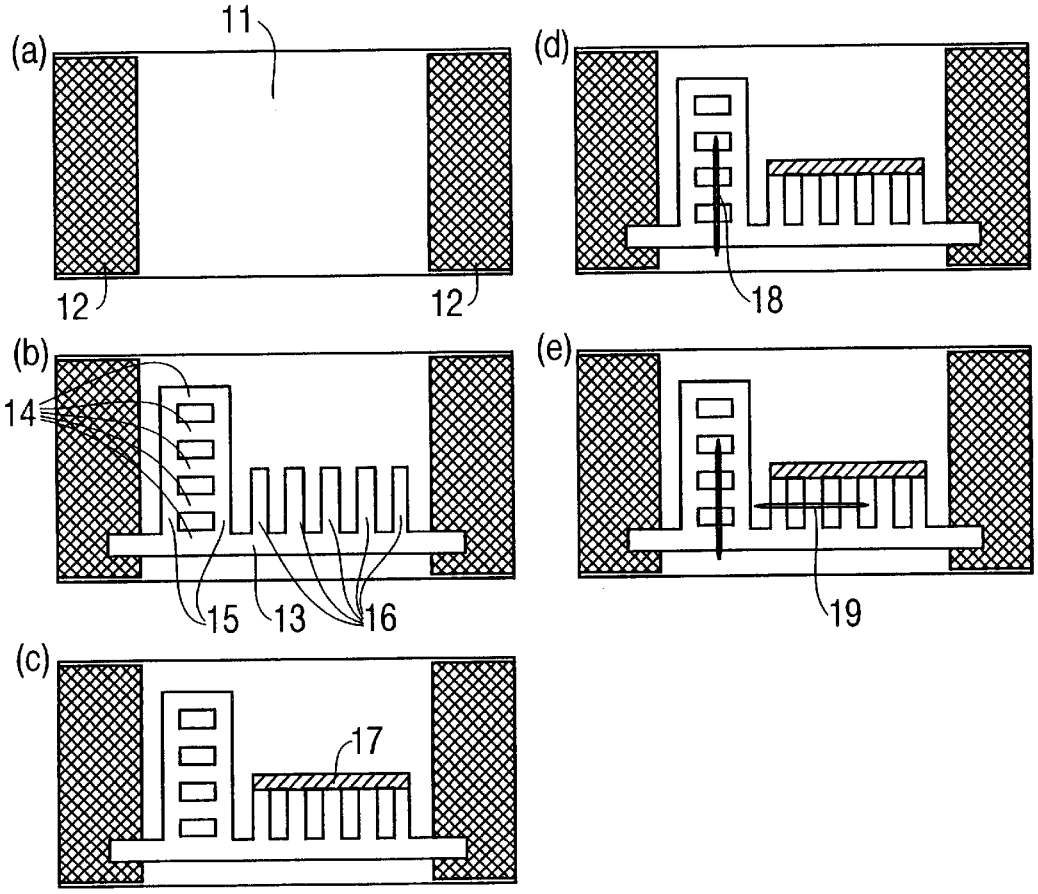
FIG. 4 is a diagram explaining steps of producing the resistor shown in FIG. 3.

FIG. 4 illustrates steps of the method of making the resistor of the second embodiment of the present invention.

The method starts with coating the substrate 11 made mainly of 96% pure alumina with a printed pattern of silver glazing paste for the electrodes 12 and then passing it in a conveyor belt oven for baking at 850° C. for 5 to 10 minutes, a total of 30 to 60 minutes, to cure the electrodes 12, as shown in FIG. 4(*a*).

Then, a pattern of a resistive body which comprises a main resistance path 13 connecting the two electrodes 12, a set of first rungs 14 arranged parallel to the main resistance path 13, a pair of first connecting paths 15 joining the first rungs 14 inbetween and connected to the main resistance path 13, and a set of second rungs 16 extending vertically from the main resistance path 13 is printed with a ruthenium oxide glazing paste, as shown in FIG. 4(*b*).

Subsequently, a pattern of the second connecting path 17 which joins the second rungs 16 together is printed with another ruthenium oxide paste of which specific resistance is higher than that of the main resistance path 13, as shown in FIG. 4(*c*). The substrate 11 with the patterns printed thereon is baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can further be adjusted to a final, precise resistance of trimming of the second rungs 16 is obtained, as shown in FIG. 4(*d*).

Also, such a number of the second rungs 16 from one side are cut apart by laser trimming that the final, precise resistance is obtained, as shown in FIG. 4(*e*). As the result, a resistor having the final, precise resistance will be completed.

The laser trimming of a number of the rungs of the ladder-like resistance paths of the resistive body depends on a resistance level of the resistor.

The operation of the resistor of the second embodiment of the present invention is now explained.

The combination of the two ladder-like resistance paths for rough and fine adjustment of the resistance in the resistor of the second embodiment, like the first embodiment, allows the resistance of the resistor to be adjusted to a desired value at a higher precision, hence providing improved load-, surge-, and pulse-resistant characteristics. In addition, the laser trimming of the rungs 16 of the second ladder-like resistance path produces a smaller change in the resistance than that of the first embodiment thus ensuring more precise adjustment.

Third Embodiment

Figure 5:
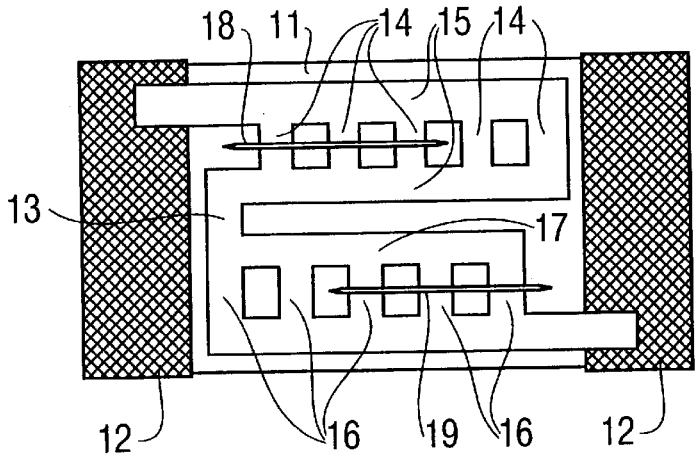
FIG. 5 is a plan view of a resistor according to a third embodiment of the present invention.

FIG. 5 is a plan view of a resistor according to a third embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is provided between the two electrodes 12 and arranged in such a zigzag so that the rungs of both a first and a second ladder-like resistance path extend in the same direction. Denoted by 14 are a set of first rungs arranged in parallel to the main resistance path 13 and bridged between a couple of first connecting paths 15 joined to the main resistance path 13. Accordingly, the first rungs 14 and the two first connecting paths 15 constitute the first ladder-like resistance path of which rungs extend in parallel to the main resistance path 13. Also, a set of second rungs 16 extend vertically from the main resistance path 13. The second rungs 16 are joined by a second connecting path 17. Accordingly, the second rungs 16 and the second connecting path 17 constitute the second ladder-like resistance path of which rungs extend vertically from the main resistance path 13. The segments 13, 14, 15, 16 and 17 are members of a resistive body made of e.g. ruthenium oxide. Denoted by 18 is a first slit groove formed by laser trimming of the first ladder-like resistance path for rough adjustment of the resistance. Similarly, a second slit groove 19 is formed by laser trimming of the rungs 16 of the second ladder-like resistance path for fine adjustment of the resistance.

A method of making the resistor of the third embodiment of the present invention will be described in detail.

Figure 6:
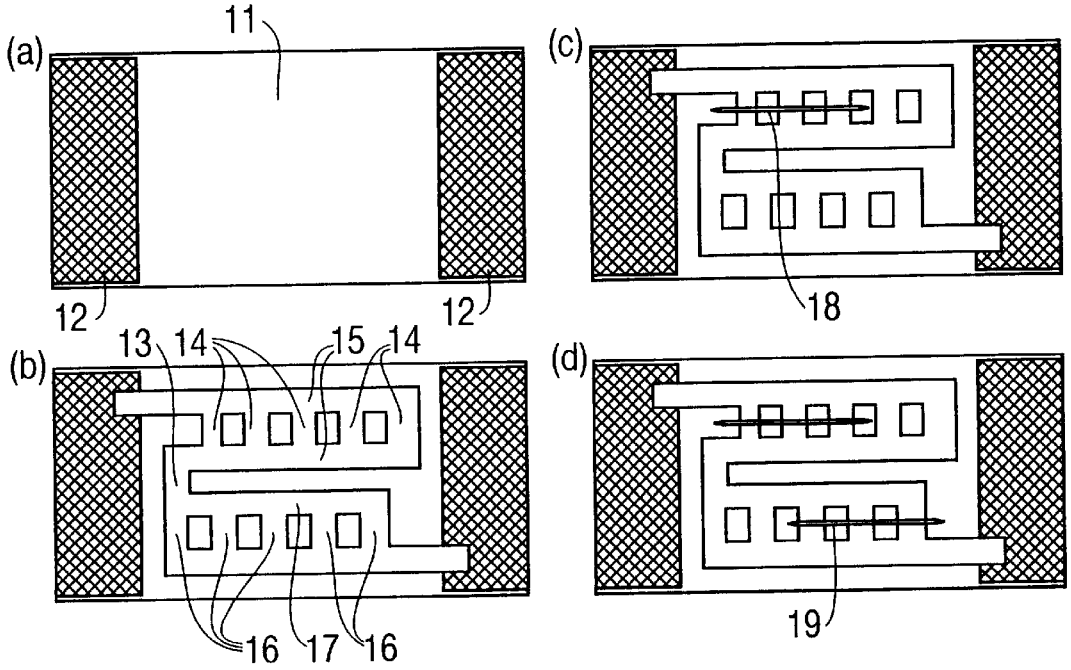
FIG. 6 is a diagram explaining steps of producing the resistor shown in FIG. 5.

FIG. 6 illustrates steps of the method of making the resistor of the third embodiment of the present invention.

The method starts with coating the substrate 11 made mainly of 96% pure alumina with a printed pattern of silver glazing paste for the electrodes 12 and then passing it in a conveyor belt oven for baking at 850° C. for 5 to 10 minutes, a total of 30 to 60 minutes, to cure the electrodes 12, as shown in FIG. 6(*a*).

Then, a pattern of a resistive body which has the main resistance path 13 extending between the two electrodes 12 and the rungs 14 and 16 of the two ladder-like resistance paths arranged in the same direction is printed with a ruthenium oxide glazing paste, as shown in FIG. 6(*b*), and baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can further be adjusted to a final, precise resistance by trimming of the second rungs 16 is obtained, as shown in FIG. 6(*c*).

Also, such a number of the second rungs 16 from one side are cut apart by laser trimming that the final, precise resistance is obtained, as shown in FIG. 6(*d*). As the result, a resistor having the final, precise resistance will be completed.

The laser trimming of a number of the rungs of the ladder-like resistance paths of the resistive body depends on a resistance level of the resistor.

The operation of the resistor of the third embodiment of the present invention is now explained.

The combination of the two ladder-like resistance paths for rough and fine adjustment of the resistance in the resistor of the third embodiment, like the first embodiment, allows the resistance of the resistor to be adjusted to a desired value at a higher precision, hence providing improved load-, surge-, and pulse-resistant characteristics. In addition, the resistor of this embodiment is identical in circuitry construction to that of the first embodiment but has an improved locational assignment of the two ladder-like resistance paths for highly efficient use of the limited area. As the result, the entire space required for the resistor of the third embodiment will be minimized contributing to the smaller size of the resistor.

Fourth Embodiment

Figure 7:
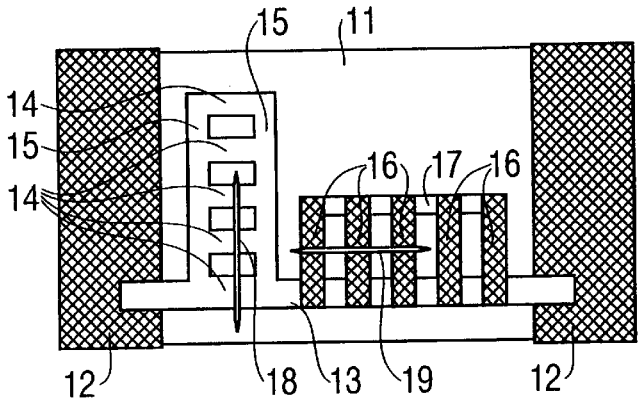
FIG. 7 is a plan view of a resistor according to a fourth embodiment of the present invention.

FIG. 7 is a plan view of a resistor according to a fourth embodiment of the present invention. There are shown a substrate 11 made of alumina steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is provided between the two electrodes 12 and arranged in parallel to a set of first rungs 14. The first rungs 14 are bridged between a couple of first connecting paths 15 joined to the main resistance path 13. Accordingly, the first rungs 14 and the two first connecting paths 15 constitute a first ladder-like resistance path of which rungs extend in parallel to the main resistance path 13. Also, a set of second rungs 16 extend vertically from the main resistance path 13. The second rungs 16 are joined by a second connecting path 17. Accordingly, the second rungs 16 and the second connecting path 17 constitute a second ladder-like resistance path of which rungs extend vertically from the main resistance path 13. The segments 13, 14, 15, and 17 are members of a resistive body made of e.g. ruthenium oxide. The second rungs 16 are conductors made of silver-paradium, copper, gold, or the like. Denoted by 18 is a first slit groove formed by laser trimming of the first ladder-like resistance path for rough adjustment of the resistance. Similarlly, a second slit groove 19 is formed by laser trimming of the rungs 16 of the second ladder-like resistance path for fine adjustment of the resistance.

A method of making the resistor of the fourth embodiment of the present invention will be described in detail.

Figure 8:
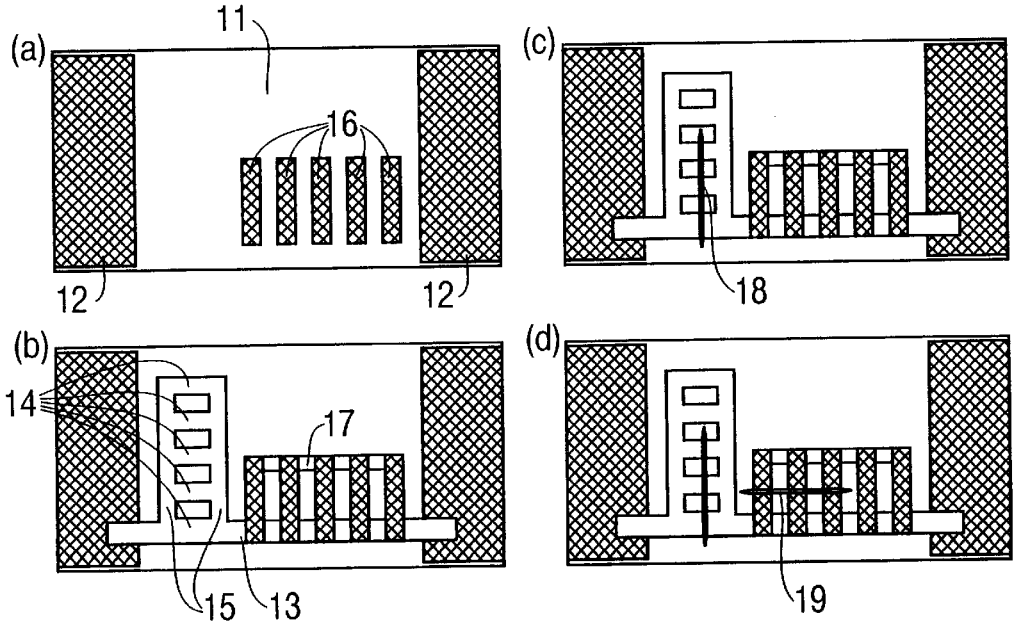
FIG. 8 is a diagram explaining steps of producing the resistor shown in FIG. 7.

FIG. 8 illustrates steps of the method of making the resistor of the fourth embodiment of the present invention.

The method starts with coating the substrate 11 made mainly of 96% pure alumina with a printed pattern of silver glazing paste to shape the electrodes 12 and the second rungs 16 and then passing it in a conveyor belt oven for baking at 850° C. for 5 to 10 minutes, a total of 30 to 60 minutes, to cure the electrodes 12 and the second rungs 16, ass shown in FIG. 8(*a*).

Then, a pattern of a resistive body which comprises a main resistance path 13 connecting the two electrodes 12, a set of first rungs 14 arranged parallel to the main resistance path 13, a pair of first connecting paths 15 joining the first rungs 14 inbetween and connected to the main resistance path 13, and a second connecting path 17 joining the second rungs 16 of the conductors together is printed with a ruthenium oxide glazing paste, as shown in FIG. 8(*b*) and baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can further be adjusted to a final, precise resistance by trimming of the second rungs 16 is obtained as shown in FIG. 8(*c*).

Also, such a number of the second rungs 16 from one side are cut apart by laser trimming that the final, precise resistance is obtained, as shown in FIG. 8(*d*). As the result, a resistor having the final, precise resistance will be completed.

The laser trimming of a number of the rungs of the ladder-like resistance paths of the resistive body depends on a resistance level of the resistor.

The operation of the resistor of the fourth embodiment of the present invention is now explained.

The combination of the two ladder-like resistance paths for rough and fine adjustment of the resistance in the resistor of the fourth embodiment, like the first embodiment, allows the resistance of the resistor to be adjusted to a desired value at a higher precision, hence providing improved load-, surge-, and pulse-resistant characteristics. Also, the change of resistance by laser trimming the rungs 16 of the second ladder-like resistance path is proportional to the number of the trimmed rungs 16 since the second rungs 16 are identical in the resistive cross section and will thus be increased in the accuracy ensuring more precise adjustment.

Fifth Embodiment

Figure 9:
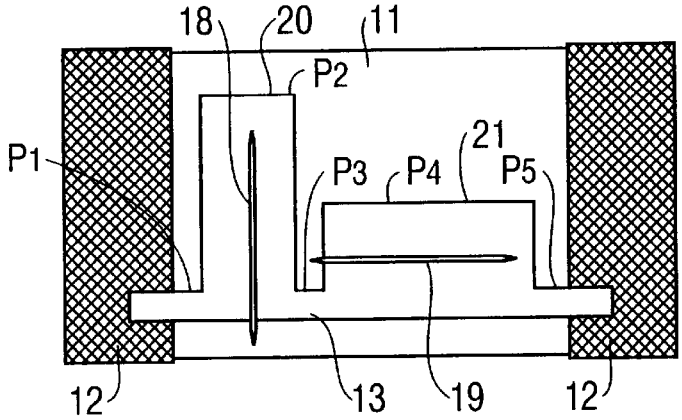
FIG. 9 is a plan view of a resistor according to a fifth embodiment of the present invention.

FIG. 9 is a plan view of a resistor according to a fifth embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is arranged to extend between the two electrodes 12 and is formed of first through fifth continuously connected consecutive portions P1 through P5 therebetween. Portions P1, P3 and P5 each have a common width of all portions is defined as the (direction at a right angle to the main resistance path 13). The lengths direction parallel to the main resistance path 13. Portion P2 is a first resistance adjusting path 20 and portion P4 is a second resistance adjusting path 21. As shown in FIG. 9, the length and width of portions P2 (fourth and third distances, respectively) and P4 (sixth and fifth distances, respectively) are each greater than the length (second distances) and width (first common distance) of portions P1, P3 and P5, with width of portion P2 greater than its length and the width of portion P4 less than its length. In addition, the width of P2 is greater than the width of P4 and the length of P2 is less than the length of P4. The first resistance adjusting path 20 is provided in which a first slit groove 18 is scored vertical to the main resistance path 13. The second resistance adjusting path 21 is provided in which a second slit groove 19 is scored parallel to the main resistance path 13. The first slit groove 18 is formed by laser trimming of the first resistance adjusting path 20 at a right angle to the main resistance path 13 for rough adjustment of the resistance. Similarlly, the second slit groove 19 is formed by laser trimming of the second resistance adjusting path in parallel to the main resistance path 13 for fine adjustment of the resistance. The members 13, 20, and 21 are made of a resistive body of e.g. ruthenium oxide.

A method of making the resistor of the fifth embodiment of the present invention will be described in detail.

Figure 10:
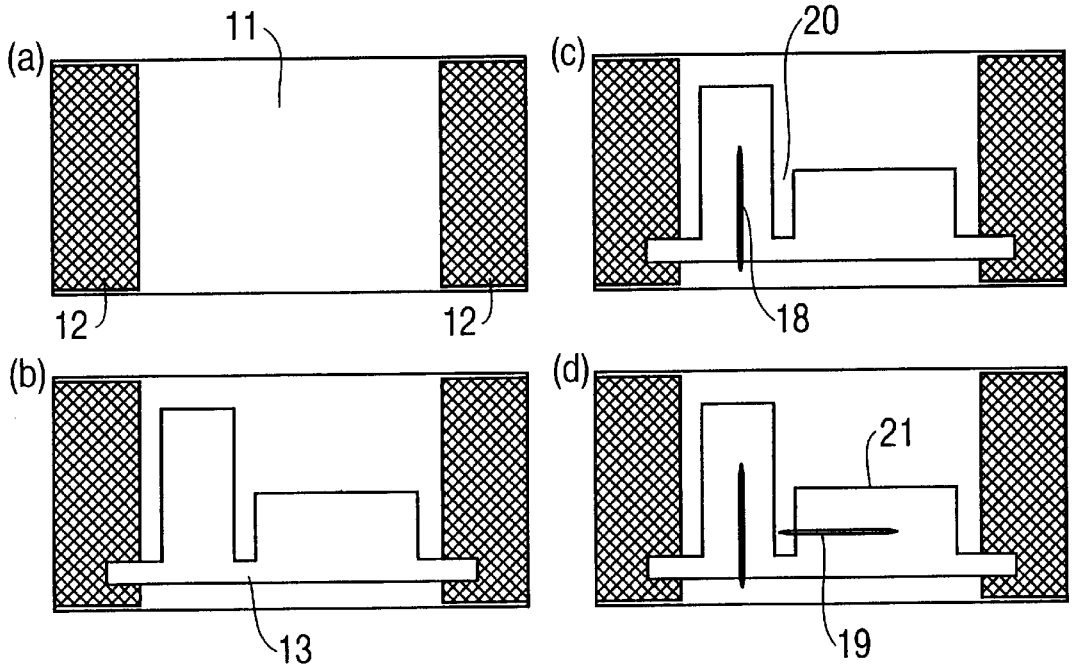
FIG. 10 is a diagram explaining steps of producing the resistor shown in FIG. 9.

FIG. 10 illustrates steps of the method of making the resistor of the fifth embodiment of the present invention.

The method starts with coating the substrate 11 made mainly of 96% pure alumina with a printed pattern of silver glazing paste for the electrodes 12 and then passing it in a conveyor belt oven for baking at 850° C. for 5 to 10 minutes, a total of 30 to 60 minutes, to cure the electrodes 12, as shown in FIG. 10(*a*).

Then, a pattern of the resistive body which comprises a main resistance path 13 connecting the two electrodes 12, a first resistance adjusting path 20 in which the first slit groove 18 is scored vertical to the main resistance path 13 for rough adjustment of the resistance, and a second resistance adjusting path 21 in which the second slit groove 19 is scored parallel to the main resistance path 13 for fine adjustment of the resistance is printed with a ruthenium oxide glazing paste, as shown in FIG. 10(*b*) and baked in a conveyor belt oven at 850° C. for 5 to 10 minutes, a total of 30 to 60 minutes, for solidification, This is followed by scoring with a beam of laser the first resistance adjusting path 20 from the main resistance path 13 side so that a roughly desired value of resistance which can further be adjusted to a final, precise resistance by trimming of the second resistance adjusting path 21 is obtained, as shown in FIG. 10(*c*).

Also, the second resistance adjusting path 21 from one side is scored by laser trimming so that the final, precise resistance is obtained, as shown in FIG. 10(*d*). As the result, a resistor having the final, precise resistance will be completed.

The distance of the slit grooves scored in the resistance adjusting paths of the resistive body depends on a resistance level of the resistor.

The operation of the resistor of the fifth embodiment of the present invention is now explained.

As the first resistance adjusting path 20 has been scored from the main resistance path 13 side, its resistive length is increased hence allowing the resistance to be changed greatly for rough adjustment. When the second resistance adjusting path 21 has been laser trimmed from one side, its resistive cross section is changed while its length remains unchanged. Accordingly, the change in the resistance is small and substantially proportional to the length of the slit groove 19, whereby fine adjustment of the resistance will favorably be made.

For example, the first resistance adjusting path 20 is scored to have a rough value equal to −10% to −2% of the desired resistance and then, the second resistance adjusting path 21 is trimmed to have the desired resistance with allowances of ±0.1% to ±1%. As the result, the resistor of the fifth embodiment will be facilitated in fabrication and eased for more precise adjustment of the resistance.

Since the length of each resistance path is increased, the loss of electricity will be prevented from being concentrated about the slit grooves 18 and 19 or injured parts by heat of the laser contributing to the higher load-, surge-, and pulse-resistant characteristics of the resistor.

Also, when the slit groove 19 scored in the second resistance adjusting path 21 is located far from the main resistance path 13, the change of the resistance is minimized thus ensuring more precise adjustment of the resistance. Furthermore, the first and second resistance adjusting paths 20 and 21 are greater in the resistive cross section than the main resistance path 13, whereby the loss of electricity concentrated about the scored parts injured by heat of the laser will be minimized hence contributing to the higher load-, surge-, and pulse-resistant characteristics of the resistor.

Sixth Embodiment

Figure 11:
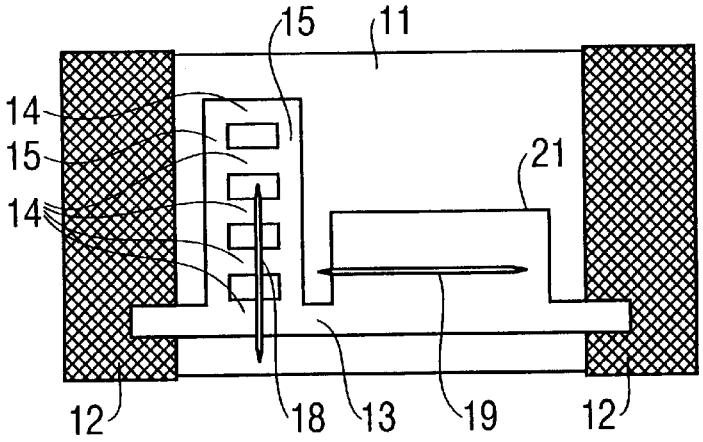
FIG. 11 is a plan view of a resistor according to a sixth embodiment of the present invention.

FIG. 11 is a plan view of a resistor according to a sixth embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is provided between the two electrodes 12 and arranged in parallel to a set of first rungs 14. The first rungs 14 are bridged between a couple of first connecting paths 15 joined to the main resistance path 13. Accordingly, the first rungs 14 and the two first connecting paths 15 constitute a first ladder-like resistance path of which rungs extend in parallel to the main resistance path 13. Denoted by 18 is a first slit groove formed by laser trimming of the first ladder-like resistance path for rough adjustment of the resistance. There is provided a second resistance adjusting path 21 in which a second slit groove 19 is scored parallel to the main resistance path 13 for fine adjustment of the resistance. The second slit groove 19 is scored in parallel to the main resistance path 13 by laser trimming for decreasing the resistive cross section of the second resistance adjusting path 21. The members 13, 14, 15, and 21 are made of a resistive body of e.g. ruthenium oxide.

A method of making the resistor of the sixth embodiment of the present invention will be described in detail.

Figure 12:
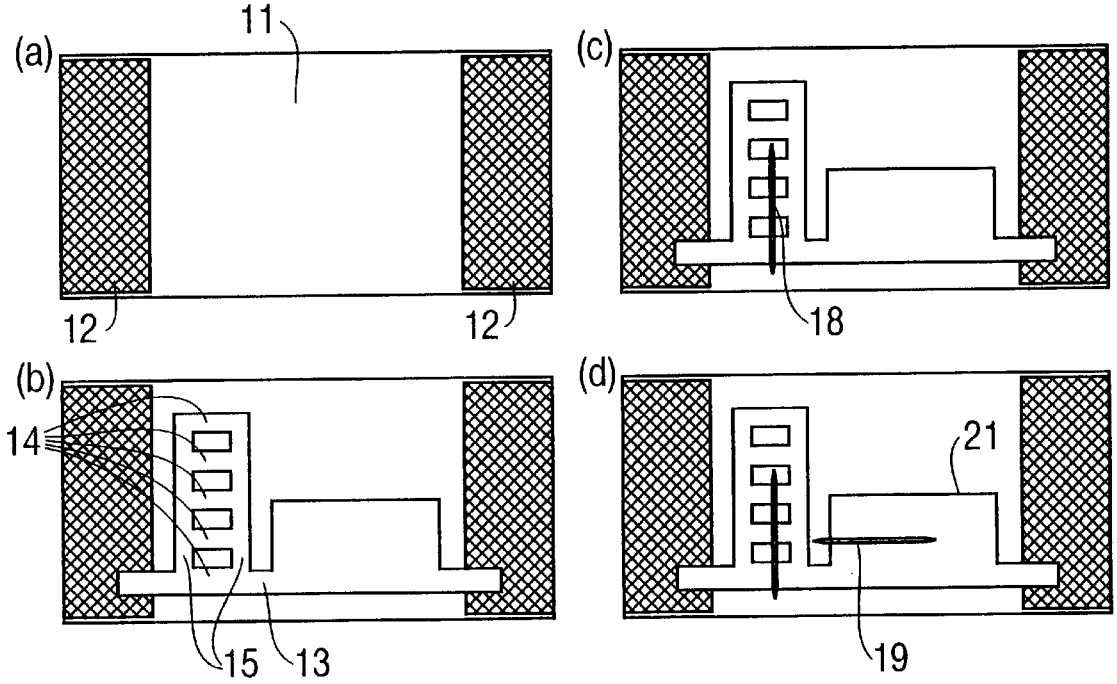
FIG. 12 is a diagram explaining steps of producing the resistor shown in FIG. 11.

FIG. 12 illustrates steps of the method of making the resistor of the sixth embodiment of the present invention.

The method starts with coating the substrate 11 made mainly of 96% pure alumina with a printed pattern of silver glazing paste for the electrodes 12 and then passing it in a conveyor belt oven for baking at 850° C. for 5 to 10 minutes, a total of 30 to 60 minutes, to cure the electrodes 12, as shown in FIG. 12(*a*).

Then, a pattern of a resistive body which comprises a main resistance path 13 connecting the two electrodes 12, a set of first rungs 14 arranged parallel to the main resistance path 13, a pair of first connecting paths 15 joining the first rungs 14 inbetween and connected to the main resistance path 13, and a second resistance adjusting path 21 having a second slit groove 19 scored therein in parallel to the main resistance path 13 is printed with a ruthenium oxide glazing paste, as shown in FIG. 12(*b*) and baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can further be adjusted to a final, precise resistance by scoring the second resistance adjusting path 21 is obtained, as shown in FIG. 12(*c*).

Also, the second resistance adjusting path 21 is scored from one side by laser trimming so that the final, precise resistance is obtained, as shown in FIG. 12(*d*). As the result, a resistor having the final, precise resistance will be completed.

The laser trimming of a number of the rungs of the ladder-like resistance path and the determining a scoring distance of the resistance adjusting path depend on a resistance level of the resistor.

The operation of the resistor of the sixth embodiment of the present invention is now explained.

When the rungs 14 of the first ladder-like resistance path are laser trimmed by cutting a given number, the resistive length of the path is increased thus producing a great change in the resistance to permit rough adjustment. Also, as the second resistance adjusting path 21 has been scored in parallel to the main resistance path 13, its resistive cross section is changed while its length remains unchanged. Accordingly, the change in the resistance is small and substantially proportional to the length of the slit groove 19, whereby fine adjustment of the resistance will favorably be made.

For example, the first rungs 14 are trimmed to have a rough value equal to −10% to −2% of the desired resistance and then, the second resistance adjusting path 21 is scored to have the desired resistance with allowances of ±0.1% to ±1%. As the result, the resistor of the sixth embodiment will be facilitated in fabrication and eased for more precise adjustment of the resistance.

The trimmed rungs 14 of the ladder-like resistance path are cut apart with a beam of laser and may be injured by heat of the laser beam. The injured parts however are not loaded with any current and will allow the loss of electricity to be hardly concentrated, whereby the resistor will be increased in the load-, surge-, and pulse-resistant characteristics.

Also, when the slit groove 19 scored in the second resistance adjusting path 21 is located far from the main resistance path 13, the change of the resistance is minimized thus ensuring more precise adjustment of the resistance.

Seventh Embodiment

Figure 13:
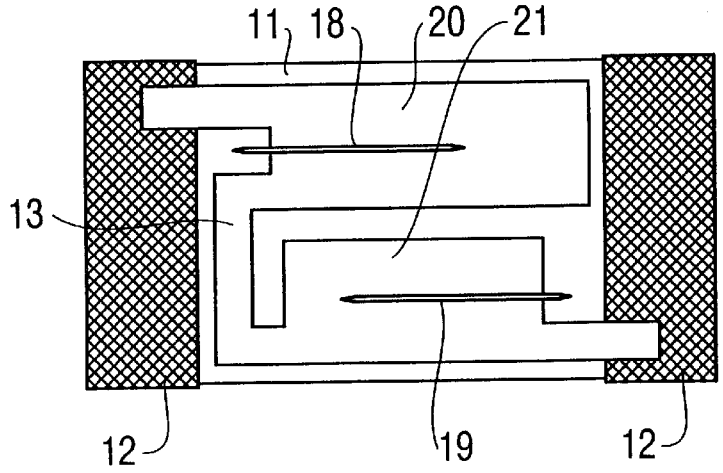
FIG. 13 is a plan view of a resistor according to a seventh embodiment of the present invention.

FIG. 13 is a plan view of a resistor according to a seventh embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is arranged in Z shape between the two electrodes 12 so that two slit grooves scored in their respective resistance adjusting paths extend in the same direction. A first resistance adjusting path 20 is provided in which a first slit groove 18 is scored vertical to the main resistance path 13. A second resistance adjusting path 21 is provided in which a second slit groove 19 is scored parallel to the main resistance path 13. The first slit groove 18 is formed by laser trimming of the first resistance adjusting path 20 at a right angle to the main resistance path 13 for rough adjustment of the resistance. Similarly, the second slit groove 19 is formed by laser trimming of the second resistance adjusting path in parallel to the main resistance path 13 for fine adjustment of the resistance. The members 13, 20, and 21 are made of a resistive body of e.g. ruthenium oxide.

A method of making the resistor of the seventh embodiment of the present invention will be described in detail.

Figure 14:
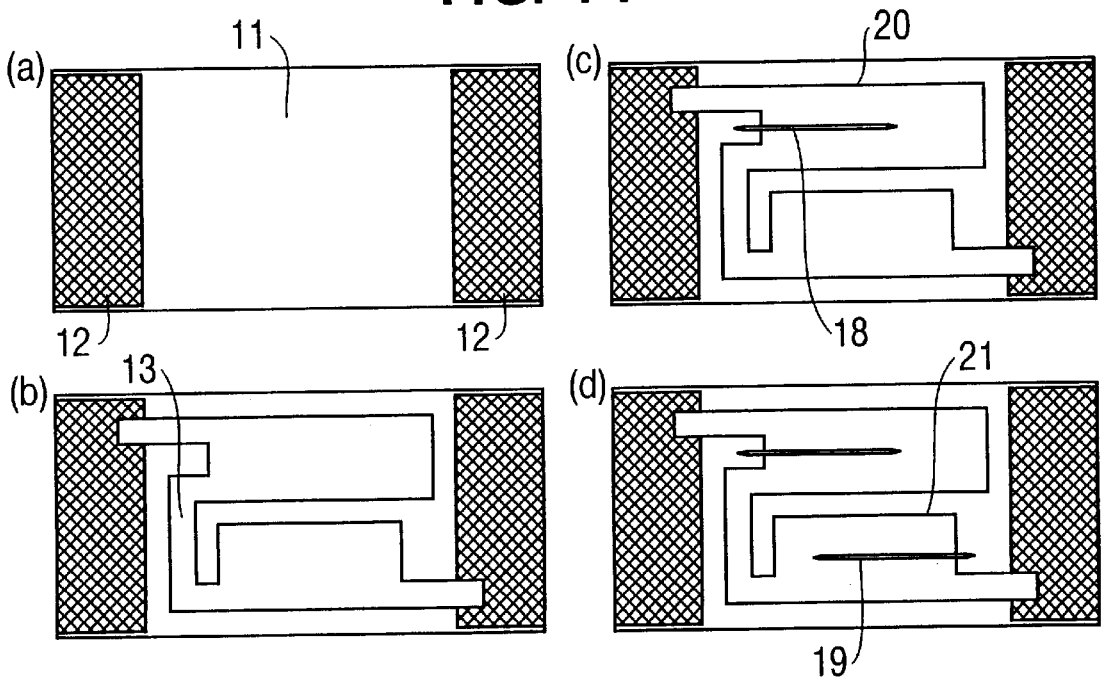
FIG. 14 is a diagram explaining steps of producing the resistor shown in FIG. 13.

FIG. 14 illustrates steps of the method of making the resistor of the seventh embodiment of the present invention.

The method starts with coating the substrate 11 made mainly of 96% pure alumina with a printed pattern of silver glazing paste for the electrodes 12 and then passing it in a conveyor belt oven for baking at 850° C. for 5 to 10 minutes, a total of 30 to 60 minutes, to cure the electrodes 12, as shown in FIG. 14(*a*).

Then, a pattern of the resistive body which comprises a main resistance path 13 connecting the two electrodes 12, a first resistance adjusting path 20 in which the first slit groove 18 is scored vertical to the main resistance path 13 for rough adjustment of the resistance, and a second resistance adjusting path 21 in which the second slit groove 19 is scored parallel to the main resistance path 13 for fine adjustment of the resistance is printed with a ruthenium oxide glazing paste, as shown in FIG. 14(*b*), and baked in a conveyor belt oven at 850° C. for 5 to 10 minutes, a total of 30 to 60 minutes, for solidification.

This is followed by scoring with a beam of laser the first resistance adjusting path 20 from the main resistance path 13 side so that a roughly desired value of resistance which can further be adjusted to a final, precise resistance by trimming of the second resistance adjusting path 21 is obtained, as shown in FIG. 14(*c*).

Also, the second resistance adjusting path 21 from one side is scored by laser trimming so that the final, precise resistance is obtained, as shown in FIG. 14(*d*). As the result, a resistor having the final, precise resistance will be completed.

The distance of the slit grooves scored in the resistance adjusting paths of the resistive body depends on a resistance level of the resistor.

The operation of the resistor of the seventh embodiment of the present invention is now explained.

The combination of the two resistance adjusting paths for rough and fine adjustments of the resistance in the resistor of the seventh embodiment, like the fifth embodiment, allows the resistance of the resistor to be adjusted to a desired value at a higher precision, hence providing improved load-, surge-, and pulse-resistant characteristics. In addition the resistor of this embodiment is identical in circuitry construction to that of the fifth embodiment but has an improved locational assignment of the two resistance adjusting paths for highly efficient use of the limited area. As the result, the entire space required for the resistor of the seventh embodiment will be minimized contributing to the smaller size of the resistor.

Eighth Embodiment

Figure 15:
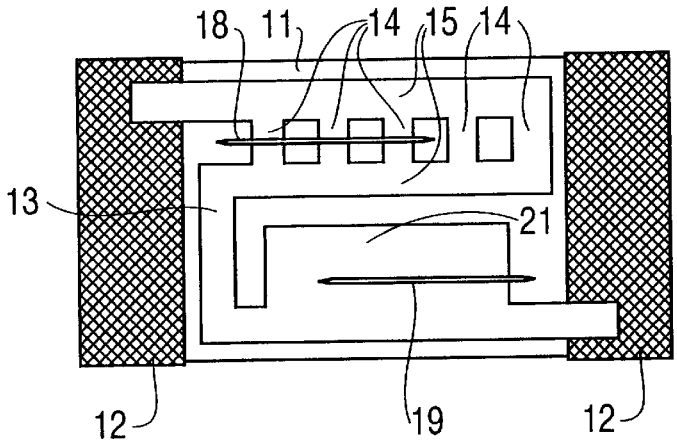
FIG. 15 is a plan view of a resistor according to an eighth embodiment of the present invention.

FIG. 15 is a plan view of a resistor according to an eighth embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both sides ends of the substrate 11 to wrap the ends to the upper and lower sides. A main resistance path 13 is arranged in a Z shape between the two electrodes 12 so that the rungs of the first ladder-like resistance path extend vertical to the slit groove in a second resistance adjusting path. The first rungs 14 of the first ladder-like resistance path are parallel to the main resistance path 13 and bridged between a couple of first connecting paths 15 joined to the main resistance path 13. Accordingly, the first rungs 14 and the two first connecting paths 15 constitute the first ladder-like resistance path of which rungs extend in parallel to the main resistance path 13. Denoted by 18 is a first slit groove formed by laser trimming of the first ladder-like resistance path for rough adjustment of the resistance. The second resistance adjusting path denoted at 21 is arranged in which the second slit groove denoted at 19 is scored parallel to the main resistance path 13 for fine adjustment of the resistance. The members 13, 14, 15, and 21 are made of a resistive body of e.g. ruthenium oxide.

A method of making the resistor of the eighth embodiment of the present invention will be described in detail.

Figure 16:
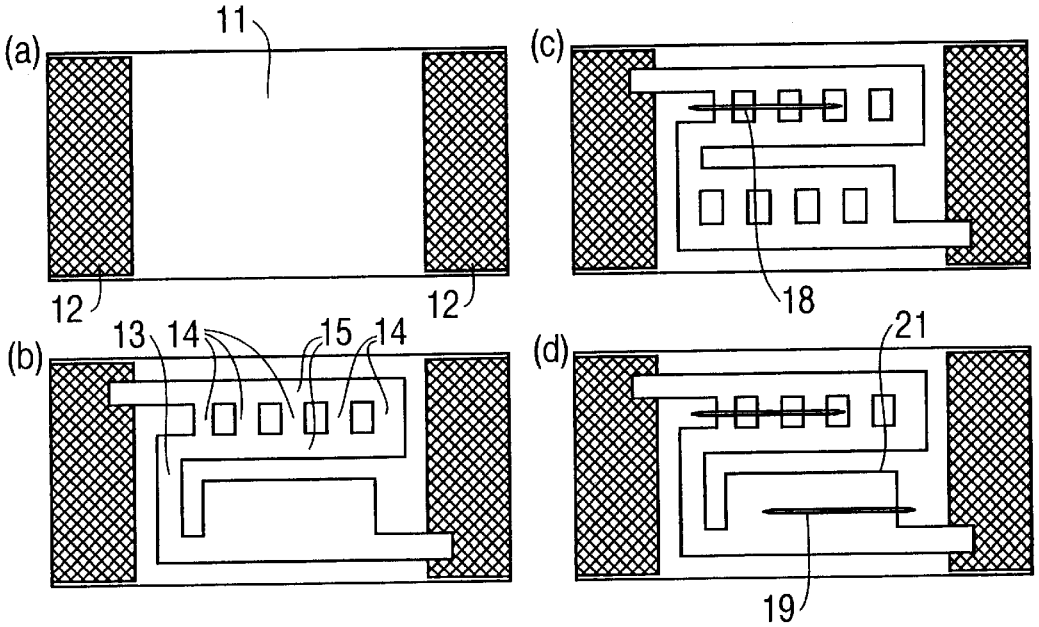
FIG. 16 is a diagram explaining steps of producing the resistor shown in FIG. 15.

FIG. 16 illustrates steps of the method of making the resistor of the eighth embodiment of the present invention.

The method starts with coating the substrate 11 made mainly of 96% pure alumina with a printed pattern of silver glazing paste to shape the electrodes 12 and the second rungs 16 and then passing it in a conveyor belt oven for baking at 850° C. for 5 to 10 minutes, a total of 30 to 60 minutes, to cure the electrodes 12, as shown in FIG. 16(*a*).

Then, a pattern of a resistive body which comprises a main resistance path 13 connecting the two electrodes 12, a set of first rungs 14 arranged parallel to the main resistance path 13, a pair of first connecting paths 15 joining the first rungs 14 inbetween and connected to the main resistance path 13, and a second resistance adjusting path 21 having a second slit groove 19 scored therein in parallel to the main resistance path 13 is printed with a ruthenium oxide glazing paste, as shown in FIG. 16(*b*) and baked in a conveyor belt oven at 850° C. for 5 to 10 minutes, a total of 30 to 60 minutes, for solidification.

This is followed by laser trimming the first rungs 14 from the main resistance path 13 side so that a roughly desired value of resistance which can further be adjusted to a final, precise resistance by scoring the second resistance adjusting path 21 is obtained, as shown in FIG. 16(*c*).

Also, the second resistance adjusting path 21 is scored from one side by laser trimming so that the final, precise resistance is obtained, as shown in FIG. 16(*d*). As the result, a resistor having the final, precise resistance will be completed.

The laser trimming of a number of the rungs of the ladder-like resistance path and the determining a scoring distance of the resistance adjusting path depend on a resistance level of the resistor.

The operation of the resistor of the sixth embodiment of the present invention is now explained.

A combination of the first ladder-like resistance path for rough adjustment of the resistance and the second resistance adjusting paths for rough adjustment of the resistance in the resistor of the eighth embodiment, like the sixth embodiment, allows the resistance of the resistor to be adjusted to a desired value at a higher precision, hence providing improved load-, surge-, and pulse-resistant characteristics. In addition, the resistor of this embodiment is identical in circuitry construction so that of the sixth embodiment but has an improved locational assignment of the resistive body for highly efficient use of the limited area. As the result, the entire space required for the resistor of the eighth embodiment will be minimized contributing to the smaller size of the resistor.

Ninth Embodiment

Figure 17:
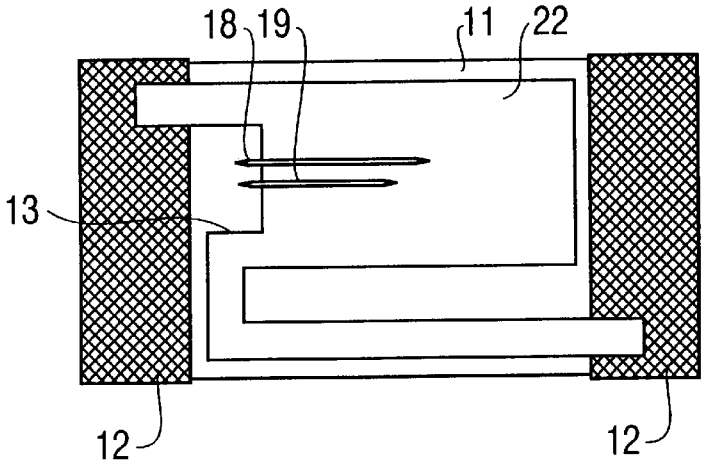
FIG. 17 is a plan view of a resistor according to a ninth embodiment of the present invention.

FIG. 17 is a plan view of a resistor according to a ninth embodiment of the present invention. There are shown a substrate 11 made of alumina, steatite, forsterite, beryllia, titania, glass, glass ceramic, or the like, and a pair of electrodes 12 made of silver, silver-paradium, copper, gold, or the like and located on both side ends of the substrate 11 to wrap the ends to the upper and lower sides. A main resistance path 13 is arranged in Z shape between the two electrodes 12. A resistance adjusting path 22 is provided in which a couple of slit grooves 18 and 19 are scored vertical to the main resistance path 13. The first slit groove 18 is formed by laser trimming of the resistance adjusting path 22 at a right angle to the main resistance path 13 for rough adjustment of the resistance. The second slit groove 19 is formed by laser trimming of the resistance adjusting path 22 at a right angle to the main resistance path 13 for fine adjustment of the resistance. The members 13 and 20 are made of a resistive body of e.g. ruthenium oxide.

A method of making the resistor of the ninth embodiment of the present invention will be described in detail.

Figure 18:
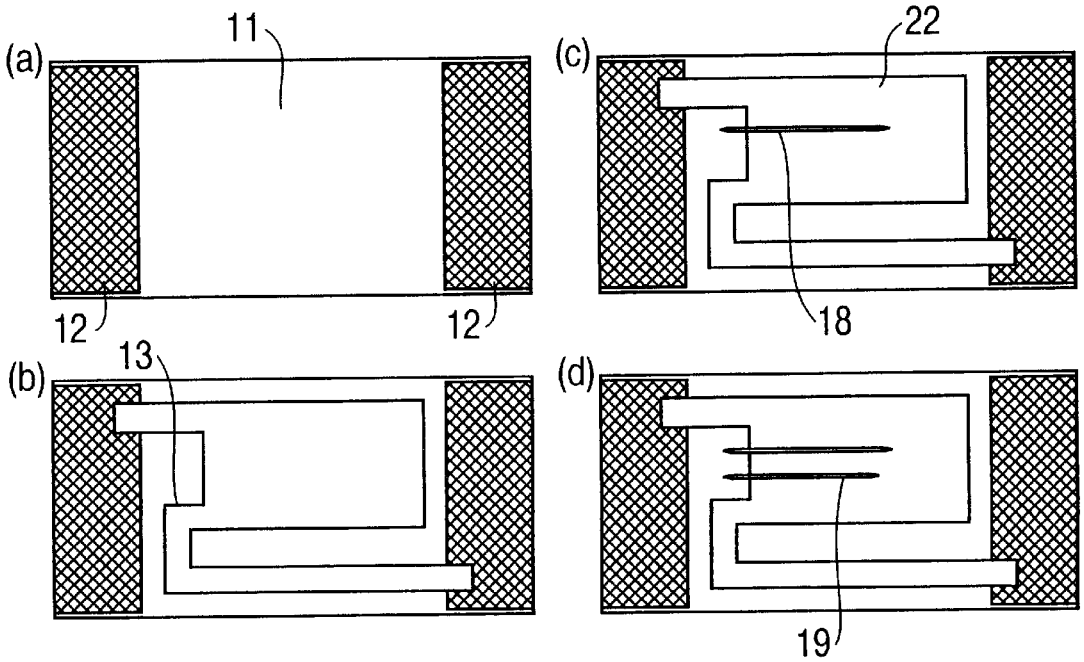
FIG. 18 is a diagram explaining steps of producing the resistor shown in FIG. 17.
Figure 19:
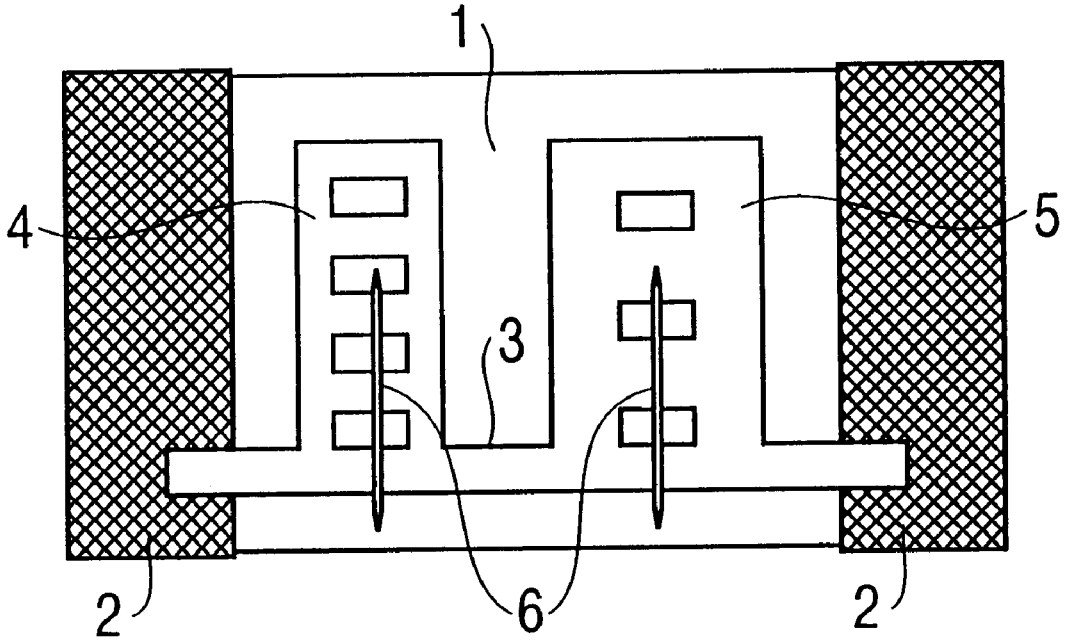
FIG. 19 is a plan view of a conventional resistor.

FIG. 18 illustrates steps of the method of making the resistor of the ninth embodiment of the present invention.

The method starts with coating the substrate 11 made mainly of 96% pure alumina with a printed pattern of silver glazing paste for the electrodes 12 and then passing it in a conveyor belt oven for baking at 850 C. for 5 to 10 minutes, a total of 30 to 60 minutes, to cure the electrodes 12, as shown in FIG. 18(*a*).

Then, a pattern of the resistive body which comprises a main resistance path 13 connecting in the Z shape between the two electrodes 12, and a resistance adjusting path 22 in which the slit grooves are scored vertical to the main resistance path 13 for adjustment of the resistance is printed with a ruthenium oxide glazing paste, as shown in FIG. 18(*b*), and baked in a conveyor belt oven at 850 C. for 5 to 10 minutes, a total of 30 to 60 minutes, for solidification.

This is followed by scoring with a beam of laser the resistance adjusting path 22 from the main resistance path 13 side to make the first slit groove 18 so that a roughly desired value of resistance which can further be adjusted to a final, precise resistance by scoring the second slit groove 19 is obtained, as shown in FIG. 18(*c*).

Also the resistance adjusting path 22 is scored adjacently to the first slit groove 18 again by laser trimming so that the final, precise resistance is obtained, as shown in FIG. 18(*d*). As the result, a resistor having the final, precise resistance will be completed.

The length of the slit grooves scored in the first resistance adjusting path 22 of the resistive body depends on a resistance level of the resistor.

The operation of the resistor of the ninth embodiment of the present invention is now explained.

As the resistance adjusting path 22 has been trimmed from the main resistance path 13 side, its resistive length is increased hence allowing the resistance to be changed greatly for rough adjustment. When the resistance adjusting path 22 is laser trimmed again to have two slit grooves therein side by side, its resistive cross section is changed while its length remains unchanged. Accordingly, the change in the resistance is small and substantially proportional to the length of the second slit groove 19, whereby fine adjustment of the resistance will favorably be made.

For example, the resistance adjusting path 22 is scored two times, firstly to have a rough value equal to −10% to −2% of the desired resistance and secondly to have the desired resistance with allowances of ±0.1% to ±1%. As the result, the resistor of the ninth embodiment will be facilitated in fabrication and eased for more precise adjustment of the resistance.

Since the length of the resistive body is increased, the loss of electricity will be prevented from being concentrated about the slit grooves 18 or injured parts by heat of the laser contributing to the higher load-, surge-, and pulse-resistant characteristics of the resistor.

Although the electrodes and the resistive body of the prescribed embodiments are fabricated by printing and baking of the silver glazing paste and the ruthenium oxide glazing paste respectively, they may be made from other appropriate electrode and resistive materials of a paste form. Also, the patterns of electrode and resistive materials may be formed by common plating, vapor deposition, or sputtering process with equal success.

As set forth above, the present invention includes a given pattern of the resistive material which comprises a first ladder-like resistance path or resistance adjusting path for rough adjustment of the resistance and a second ladder-like resistance path or resistance adjusting path for fine adjustment of the resistance, hence providing a desired resistance at a higher precision. Also, after adjustment of the resistance by laser trimming, resultant injured parts of the resistive body produced by heat of the laser trimming are prevented from unwanted concentrated consumption of electricity thus allowing the resistor to have higher load-, surge-, and pulse-resistant characteristics.

In addition, making the corner of the zigzag of the main resistance path round reduces the concentration of energy consumption at the corner, hence improving the load-, surge- and pulse-resistant characteristics.

What is claimed is:

1. A chip resistor comprising:

a rectangular substrate having first and second parallel side ends, and third and fourth parallel side ends, perpendicular to the first and second parallel side ends;

first and second electrodes respectively formed proximate the first and second parallel side ends and each extending substantially between the third and fourth parallel side ends; and a resistance path extending between the first and second electrodes, side resistance path having first through fifth continuously connected consecutive portions therebetween, the first, third and fifth portions each extending a first common distance in the direction parallel to the first and second parallel side ends and second distances in the direction perpendicular to the first and second parallel side ends, the second portion extending a third distance in the direction parallel to the first and second parallel side ends and a fourth distance in the direction perpendicular to the first and second parallel side ends, and the fourth portion extending a fifth distance in the direction parallel to the first and second parallel side ends and sixth distance in the direction perpendicular to the first and second parallel side ends, the third distance being greater than the first and fourth distances, and the fifth distance which is greater than the first distance, and the sixth distance being greater then the fifth distance, and the fourth distance, wherein said second portion is slit in the direction parallel to the first and second parallel side ends to provide rough adjustment of resistance by increasing a length of the resistance path of the second portion, and said fourth portion is slit in the direction perpendicular to the first and second parallel side ends to provide fine adjustment of resistance by changing a resistance cross section of the fourth portion while leaving a length of the resistance path of the fourth portion unchanged.

2. The chip resistor according to claim 1, wherein the resistance cross section of the second and fourth portions is greater than the first, third and fifth portions.

* * * * *